United States Patent [19]

Kibler

[11] 3,981,124

[45] Sept. 21, 1976

[54] CONCHO

[76] Inventor: Charles E. Kibler, 8325 E. Indian Bend Road, Scottsdale, Ariz. 85253

[22] Filed: Sept. 10, 1975

[21] Appl. No.: 611,959

[52] U.S. Cl. ..... 54/6 R; 24/164; 54/85

[51] Int. Cl.[2] ..... B68B 1/04

[58] Field of Search ..... 54/6 R, 6 A, 5, 74, 54/85, 28; 24/184, 172, 164, 169, 129 R, 129 B

[56] References Cited

UNITED STATES PATENTS

| | | | |
|---|---|---|---|
| 114,201 | 4/1871 | Riley | 24/164 |
| 197,186 | 11/1877 | Van Keuren | 54/85 X |
| 238,188 | 2/1881 | Ward | 54/184 X |
| 249,597 | 11/1881 | Drall | 24/164 |
| 366,416 | 7/1887 | Martin | 54/85 |
| 524,067 | 8/1894 | Martin | 54/85 |
| 660,544 | 10/1900 | Gelabert | 54/6 R |
| 844,707 | 2/1907 | Banker | 54/85 |

*Primary Examiner*—Jack Q. Lever

*Attorney, Agent, or Firm*—Sughrue, Rothwell, Mion, Zinn & Macpeak

[57] ABSTRACT

A concho for an equine harness has an outer plate and top and bottom walls which receive the loop ends of a brow band. The top and bottom walls are slotted to permit the extension therethrough, and through the loop ends, of other harness components.

3 Claims, 3 Drawing Figures

FIG. 1
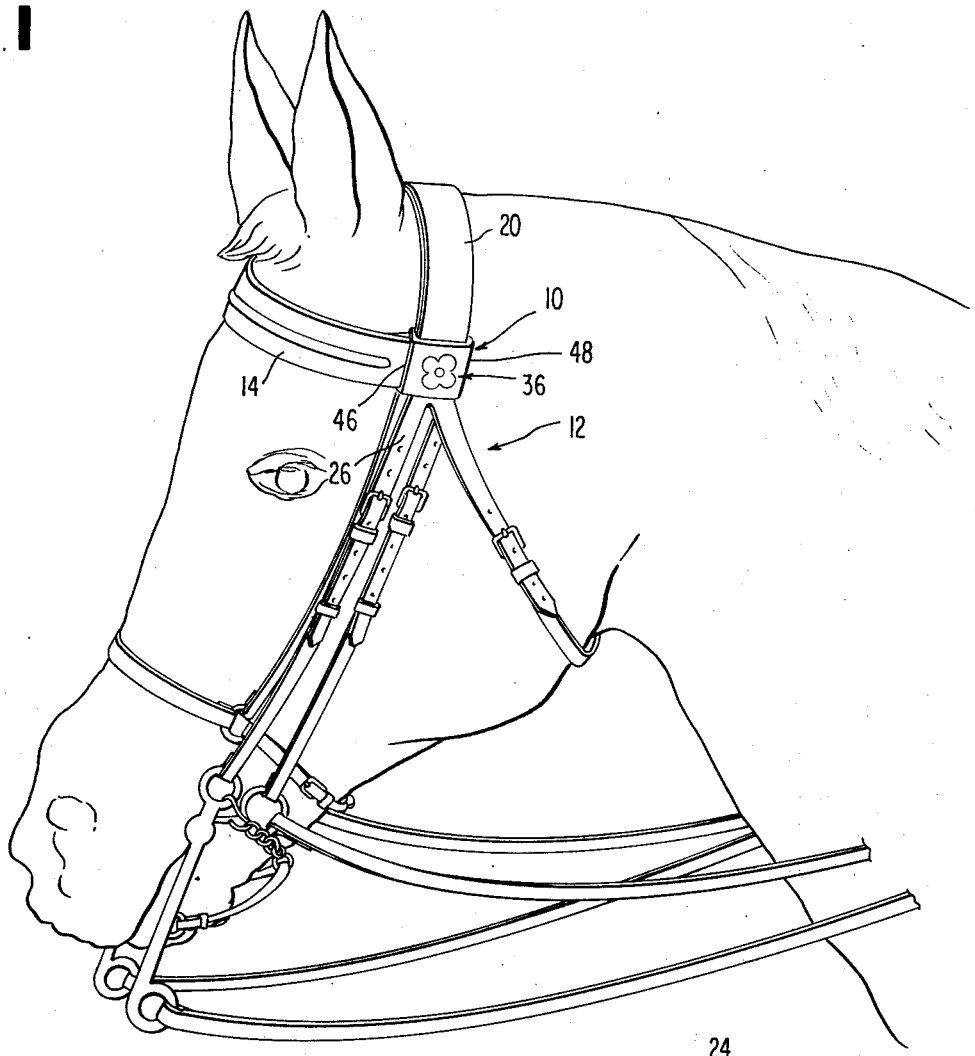
FIG. 2
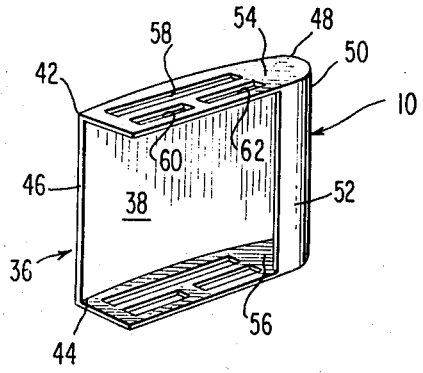
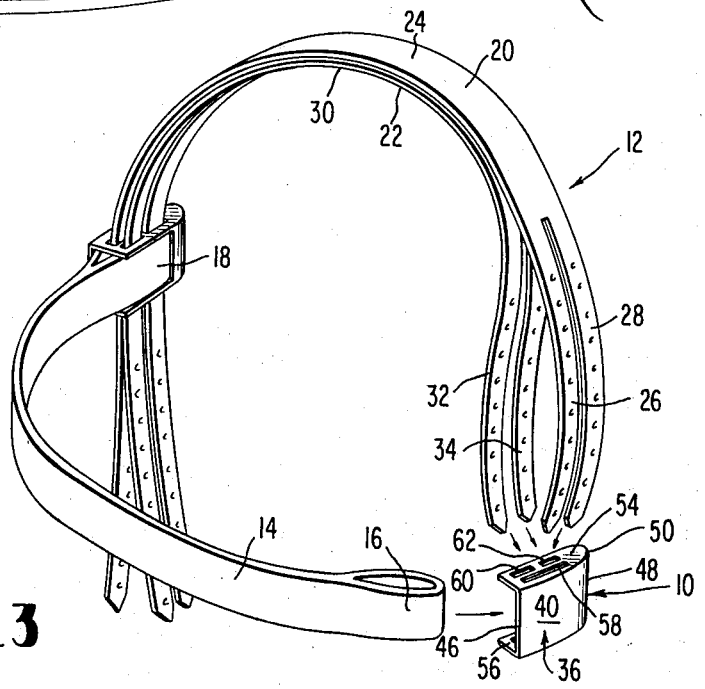
FIG. 3

CONCHO

BACKGROUND OF THE INVENTION

1. Field of the Invention

This invention pertains to harness for horses and the like, and particularly to an appliance employed in bridling of such animals.

2. Statement of the Prior Art

Prior proposals for attachments of this general nature are illustratively shown in the below listed United States patents:

| Patent No. | Patentee | Issued |
|---|---|---|
| 234,029 | Gunning | Nov. 2, 1880 |
| 921,812 | Dorf | May 18, 1909 |
| 1,086,891 | Buche | Feb. 10, 1914 |
| 2,273,136 | Orech et al. | Feb. 17, 1942 |

SUMMARY OF THE INVENTION

The present invention is directed to a concho which is adapted to hold various harness straps in correct positions, while covering the brow band at the ends whereat it is connected to the straps. This results in eliminating movement of the straps often referred to as bit hangers. The device also permits alteration of the positioning of these straps.

A central concept hereof is that of separation of the straps through individual holding compartments.

A further objective resides in the improvement of appearance of the strap positions in a bridle arrangement.

Other and further objects and advantages of the invention will become apparent to those skilled in the art from a consideration of the following specification when read in conjunction with the annexed drawings.

BRIEF DESCRIPTION OF THE DRAWING

FIG. 1 is a perspective view of a bridle harness as applied to a horse, with a concho constructed and assembled in accordance with the teachings of this invention in place thereon;

FIG. 2 is an enlarged rear perspective of the concho; and

FIG. 3 is another perspective, disassembled, of the invention on reduced scale relative to FIG. 2.

DESCRIPTION OF THE PREFERRED EMBODIMENT

Referring to the drawing in more detail the concho of this invention is therein generally identified by Reference Numeral 10. The unit 10 is formed of metal or other rigid material, and a pair thereof is required for each bridle. These units, while not limited as to environment of employment, are particularly suited to a bridle system generally known as the "English" style. A typical bridle assembly of that type is illustrated in FIGS. 1 and 3. Insofar as pertinent to this invention, the bridle 12 includes a brow band 14 having opposite loop ends 16 and 18. Two overhead straps are employed, including an outer overhead strap 20, and an underlying, inner overhead strap 22. The outer overhead strap 20 includes an imperforate main section 24, which has bifurcated end portions separated into forward bit straps 26 and aft throat latch straps 28. Each of the latter has holes therein for buckling to other portions of the bridle.

Similarly, the inner overhead strap 22 has a main section 30 with bifurcated end portions which provide front and rear hanger straps 32, 34, respectively. These also have holes formed therein for attachment to other tackle.

The concho 10 comprises a substantially rectangular outer plate 36 which may be slightly curved as shown in FIG. 2. The plate has an inner surface 38 and an outer suface 40, the latter being provided with decorative indicia. The plate has upper and lower edges 42, 44, and forward and rear edge portions 46 and 48.

Integrally joined to the rear edge portions 48 are arcuate rear walls 50, and an inside wall 52 projects therefrom in substantially parallel relation to the outer plate.

Top and bottom walls 54, 56 extend inwardly from the upper and lower edges of the plate, and are joined also to the rear walls 50 and the inside walls 52.

The top and bottom walls each have a series of co-aligned slots formed therein. These include enlarged outer slots 58 and front and rear inside slots 60, 62.

As will be observed in FIG. 3, the concho defines an area which receives the loop ends of the brow band. In such relation, the brow band loops are aligned with the slots in the top and bottom walls. In such alignment, the overhead strap including the bit strap and the throat latch strap extend through the outer slots of the concho and through the loop ends, and the front hinge straps of the inner overhead strap extend through the forward inside slots, with the rear hanger straps extending through the rear inside slots. This arrangement positively locates the overhead strap components with respect to the brow band and with respect to the other bridle components.

I claim:

1. The combination, with a bridle assembly which includes a brow band having loop ends, an outer overhead strap bifurcated to provide a forward bit strap and an aft throat latch strap, an inner overhead strap bifurcated to provide front and rear hanger straps, of conchos for said straps, comprising:

a concho at each end of the brow band, each concho having an outer plate with inner and outer surfaces, upper and lower edges, and forward and rear edge portions;

a rear wall extending inwardly from each of the rear edge portions, and an inside wall on each of the rear walls;

top and bottom walls extending inwardly from the upper and lower edges;

said top and bottom walls being fixedly secured to the respectively adjacent rear and inside walls;

the top and bottom walls having series of co-aligned slots formed therein;

the brow band extending into the conchos with the loop ends thereof encased in said conchos and bearing against the rear walls thereof;

the slots in the conchos being aligned with said loop ends, and the slots including enlarged outer slots, the overhead straps with said bit strap and throat latch strap entering through the loop and outer slots, and pairs of longitudinally aligned forward and rear inside slots, the front pin strap extending through the loop and forward inside slots, and the rear hanger straps extending through the loop and the rear inside slots.

2. The combination of claim 1, wherein:

the rear wall is curvalinear and defines with the outer plates and top and bottom walls as seat for the loop ends.

3. The invention of claim 1, wherein:

the outer plate has decorative indicia on its outer surface.

* * * * *